US005788480A

United States Patent [19]

Bentsen et al.

[11] Patent Number: 5,788,480

[45] Date of Patent: Aug. 4, 1998

[54] GRATE ELEMENT

[75] Inventors: Bo Bentsen, Valby, Denmark; Michael Robert Massaro, Bethlehem, Pa.

[73] Assignee: F. L. Smidth & Co. A/S, Denmark

[21] Appl. No.: 411,705

[22] PCT Filed: Sep. 24, 1993

[86] PCT No.: PCT/EP93/02599

§ 371 Date: Mar. 22, 1995

§ 102(e) Date: Mar. 22, 1995

[87] PCT Pub. No.: WO94/08191

PCT Pub. Date: Apr. 14, 1994

[30] Foreign Application Priority Data

Oct. 6, 1992 [DK] Denmark ..... 1228/92

[51] Int. Cl.[6] ..... F27D 15/02

[52] U.S. Cl. ..... 432/78; 110/268; 110/281; 126/163 R; 432/77

[58] Field of Search ..... 432/77, 78; 110/267, 110/268, 278, 281, 283, 288, 291, 298, 299, 328; 126/163 R, 167

[56] References Cited

U.S. PATENT DOCUMENTS

| | | | |
|---|---|---|---|
| 1,438,190 | 12/1922 | Skelly | 110/281 |
| 1,491,811 | 3/1924 | Miller | 110/281 |
| 4,776,287 | 10/1988 | Moreau | 110/281 |
| 4,870,913 | 10/1989 | Schneider | 110/299 |
| 5,174,747 | 12/1992 | Massaro, Jr. et al. | 110/268 |
| 5,322,434 | 6/1994 | Milewski et al. | 432/78 |
| 5,433,157 | 7/1995 | Dittmann et al. | 110/289 |

*Primary Examiner*—Teresa J. Walberg
*Assistant Examiner*—Jiping Lu
*Attorney, Agent, or Firm*—Baker & Botts, L.L.P.

[57] ABSTRACT

A grate element (1) for a grate surface, e.g. in a clinker cooler, is shaped in the form of a box between the walls (3, 4) of which a number of surface-defining grate bars (5, 6) are mutually arranged so that, between them, they form fine gas channels (7). The grate bars (5, 6) alternately consist of bars (5) having a substantially rectangular cross section and bars (6) having a cross section substantially of the form of an inverted T. The rectangular bars (5) overlap the transverse sections (6a) of the T-bars, each of which is provided at the free end with a projecting, longitudinal bead (17), whereas each of the rectangular bars (5) at the sides facing the T-bars (6) are correspondingly configured with depending, longitudinal beads (15). Hereby it is obtained that the grate element is effectively cooled, that the pressure loss through the grate element is appropriately large, that the grate element is protected against falling-through of material and that maintenance work in connection with the replacement of grate elements is facilitated.

30 Claims, 3 Drawing Sheets

GRATE ELEMENT

The invention relates to a grate element for a grate surface, e.g. in a clinker cooler, which grate element is shaped in the form of a box, between the walls of which a number of grate surface-defining grate bars are mutually arranged so that, between them, they form fine gas channels. Such a grate element is hereinafter referred to as "of the kind described".

The function of the grate surface of a clinker cooler, which often comprises a large number of grate elements, is partly to convey clinker material through the cooler and partly to allow the cooling gas to penetrate the clinker material for cooling hereof. The cooling gas is traditionally supplied to all the grate elements of the grate surface via one or very few common, underlying chambers. Given that, in most cases, the clinker material is not homogenous with respect to size, the clinker layer on the grate surface will not be distributed in an even and homogeneous manner, and, therefore, the passage of cooling gas through the different areas of the clinker layer will be very uneven, involving risk that so called "red rivers", i.e. sections of insufficiently cooled clinker, will be formed.

In order to resolve this problem, it has been proposed to provide each grate element in the grate surface separately with cooling gas so that the passage of gas through each single grate element can be controlled so that an even distribution of the gas across the entire grate surface is achieved. It has also been proposed to provide for a significantly greater pressure loss through the grate surface than through the clinker layer whereby it will mainly be the pressure loss through the grate surface which determines the gas distribution across the grate.

A grate element of the above kind is known from the EP-A-167658, which comprises longitudinal lateral brackets which define the width of the grate and a plurality of grate bars extending between and transversely to the brackets, hence forming, between them, a plane surface with transverse gas slots. However, this grate element has the disadvantage that its construction will not ensure a sufficient cooling of the grate surface itself, and that the wear induced as a result of the hot clinker being deposited directly on this surface will, therefore, be relatively large. Further, this known grate element is not constructed in such a way that it prevents falling-through of clinker material. A further disadvantage relates to the manner in which the grate elements are mounted, which makes it difficult to replace the individual grate element, partly because the single grate elements consist of two parts which have to be pushed together, and partly because a whole row of grate elements is assembled by means of common, through-going cross bolts.

It is the object of the invention to provide a grate element which is so constructed that it will ensure a sufficient pressure loss through the grate and hence a sufficient cooling of the grate surface, and prevent material from falling through the grate, while simultaneously ensuring uncomplicated mounting and replacement of the grate elements.

According to the invention a grate element of the kind described is characterized in that the grate bars alternately consist of bars having a substantially rectangular cross-section and bars having a cross section substantially of the form of an inverted T, in that the rectangular bars overlap the transverse flanges of the T-bars, each of which flange is provided at the free end thereof with an upwardly projecting, longitudinal bead; and in that each of the rectangular bars has at each side edge a longitudinal bead depending downwardly towards respective ones of the T-bar flanges.

It is hence ensured that the cooling gas is led through the grate element in such a manner that the grate bars with rectangular cross section, which constitute the greatest part of the grate surface, and which are the parts of the grate element exposed to the greatest thermal load, are effectively cooled. This is due to the fact that the largest pressure loss through the grate element is generated under these rectangular grate bars, which is in accordance with the Reynolds analogy which states that "a greater pressure loss will result in greater heat transfer and vice versa". Also, the construction of the grate element ensures against falling-through of material in that the peculiar construction of the gas channels with the upwardly projecting and depending beads will provide a so-called "water trap effect", hence preventing falling-through of material, even when the gas supply is interrupted. The simple construction of the grate will further facilitate the maintenance work since it will be possible to replace a single damaged grate element without having to remove any of the surrounding grate elements.

In a preferred embodiment of the invention the grate bars extend transversely to the direction of movement of the material, in use, on the grate surface, being fixed to the side walls of the grate element. But the grate bars may alternatively be fixed to the end walls of the grate element, hence extending in the direction of movement of the material, in use, on the grate surface.

The grate bars with rectangular cross section are preferably cast in one piece with the walls of the grate element, but they may alternatively be separately manufactured and fixed by means of suitable fastening means. However, the grate bars with a T-shaped profile are preferably separately manufactured and fixed to the walls of the grate element by welding.

To achieve the optimum cooling of the grate surface, it is preferred that the grate bars with a rectangular cross section constitute more than 50%, and preferably between 65 and 85%, of the active grate surface whereas the T-bars constitute between 10 and 40%, and the gas channels constitute between 2 and 7%, of the grate surface.

The water trap effect of the grate element, which prevents falling-through of material, can be further enhanced by sizing both the upwardly projecting and downwardly depending beads so that the gas inlet of each gas channel is situated at a higher level than a mid section of the gas channel.

The invention will now be described in further details with reference to the accompanying diagrammatic drawings, wherein.

Figure 1:
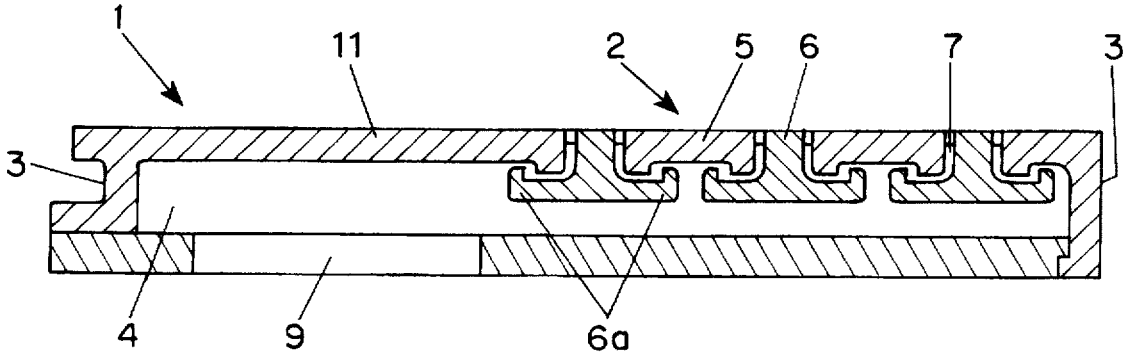
FIG. 1 is a longitudinal section of a first embodiment of a grate element according to the invention.

The grate element 1 shown in FIG. 1 is configured as a box with end walls 3 and side walls 4, comprising transverse bars or slats 5,6 extending between the side walls 4 and forming the active surface 2 of the grate element. As shown, the slats 5,6 are spaced apart in order to provide gas channels 7 between them, and they alternately consist of slats 5 having a substantially rectangular cross section and slats 6 having a cross section substantially of the form of an inverted T. The rectangular slats 5 overlap the flanges 6*a* of the T-shaped slats 6. The grate element 1 is fed, via an opening 9 in the bottom, with cooling gas which flows out through the gas channels 7 and upwardly through material being deposited on the grate surface 2. The grate surface also comprises a not cooling-active surface 11 which is overlapped by a not shown preceding grate element.

Figure 2:
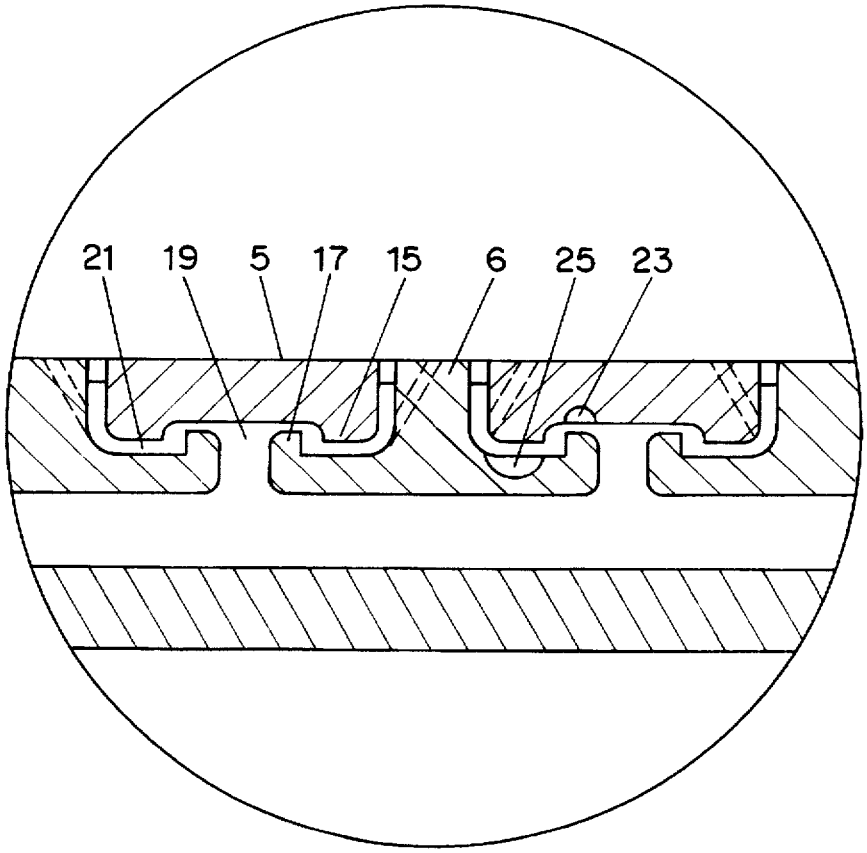
FIG. 2 shows part of FIG. 1 to larger scale.

As is best illustrated in FIG. 2, both the rectangular slats 5 and the T-shaped slats 6 are provided with beads 15 and 17, respectively. These beads 15, 17 extend along the full length of the slats and provide the grate element with a water trap effect which prevents falling-through of material in that the gas inlet 19 of each gas channel 7 is situated at a higher level than a mid section 21 of the gas channel 7. In other words the beads 15 project downwardly to a level below that to which the beads 17 project upwardly.

In order to enhance this water trap effect, the grate element 1 in the surfaces of the slats 5, 6, which face the beads 15, 17, may comprise recesses 23, 25 into or toward which the beads 15, 17 protrude.

Figure 3:
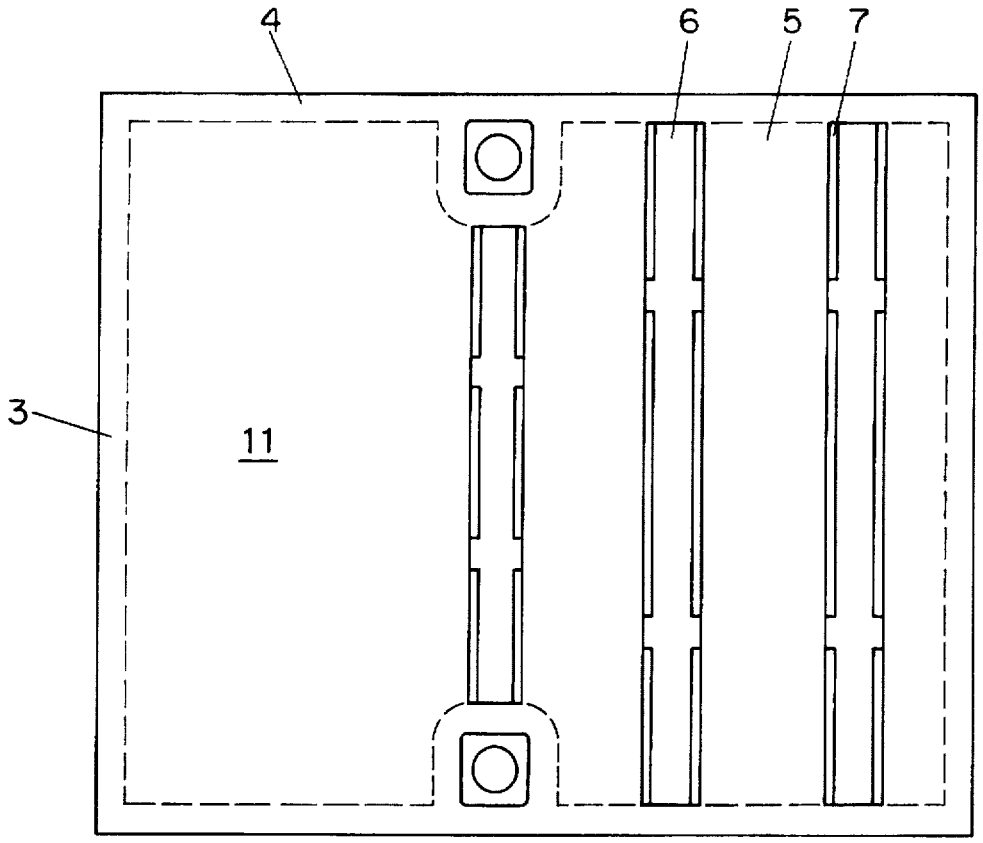
FIG. 3 is a plan of the first embodiment.

FIG. 3 shows that the gas channels 7 extend transversely to the direction of movement of the material which is deposited on the grate element 1.

Figure 4:
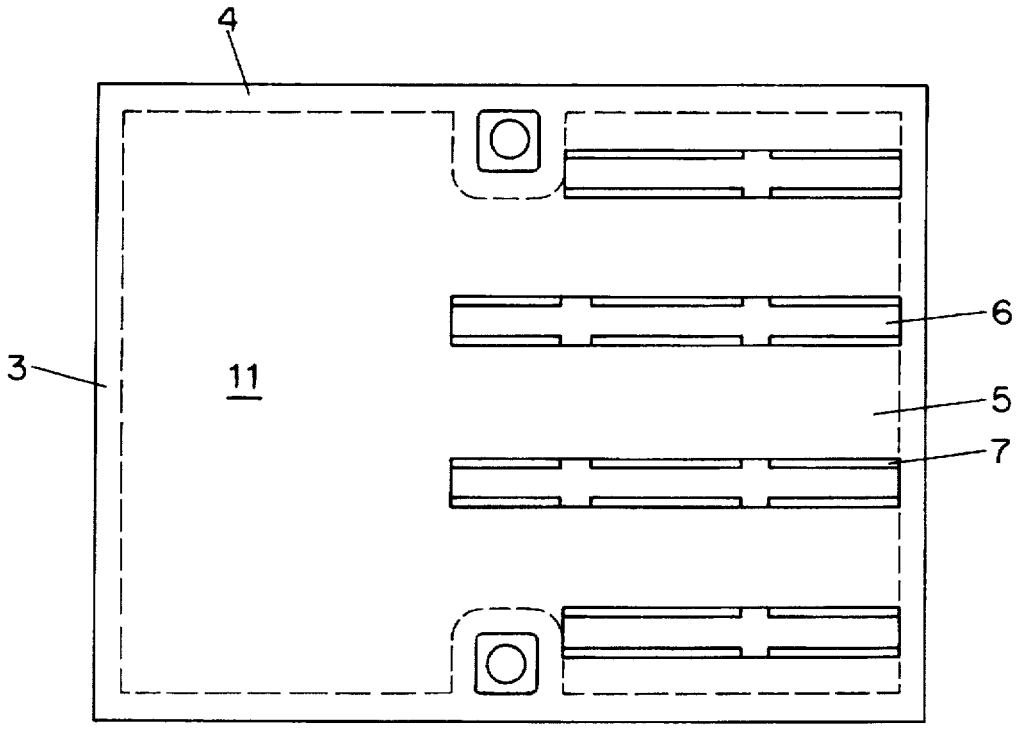
FIG. 4 is a plan of a second embodiment of a grate element according to the invention.

FIG. 4 shows the second embodiment in which the gas channels 7 extend in the direction of movement of the material.

When utilizing the grate element 1 in a clinker cooler, the cooling gas, usually atmospheric air under pressure, will flow from a gas supply beam (not shown) through the opening 9 and the gas channels 7 up through clinker material (not shown) which is deposited on top of the grate element 1. On its passage through the gas channels 7, the cooling gas will cool down the slats 5, 7 and owing to the peculiar construction of the path of the channels 7 the cooling gas will incur a certain pressure loss before the gas is directed up through the clinker material.

Figure 5:
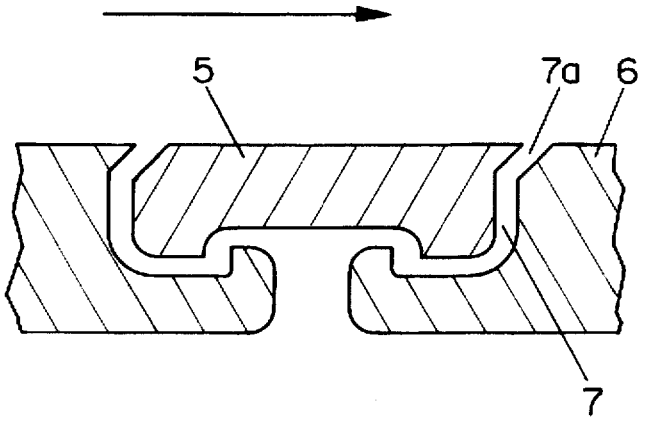
FIG. 5 is a plan of the embodiments of FIGS. 1 and 2 wherein the ends of the channels 7 terminate at the surface at an angle different than perpendicular.

In FIGS. 1 and 2, the last sections of the channels 7 extend perpendicularly to the surface of the grate element, but, as shown in FIG. 5, these sections may also be terminated at a different angle in relation to the surface, and may, for example, lead the gas forward in the direction of movement of the material or backwards in counterflow with the direction of movement of the material, or may have different angles hence dispersing the gas in different directions. As shown in FIG. 5, the last section 7*a* of channel 7 terminates at the surface of elements 5 and 6 at an angle relative to the surface such as to lead the gas forward in the direction of movement of the material as indicated by the arrow.

We claim:

1. A grate element in the form of a box having side walls, between which a number of grate surface-defining grate bars are mutually arranged so that, between them, they form gas channels having gas inlets and gas outlets, characterized in that the grate bars alternately consist of bars having a substantially rectangular cross-section and bars having a cross section substantially of the form of an inverted T with transverse flanges; in that the rectangular bars overlap the transverse flanges of the T-bars, each of which flange is provided at the free end thereof with an upwardly projecting, longitudinal bead; and in that each of the rectangular bars has at each side edge a longitudinal bead depending downwardly towards respective ones of the T-bar flanges, said grate element having an upper surface across which material to be cooled moves.

2. A grate element according to claim 1, wherein the grate bars extend transversely to the direction of movement of the material, in use, on the grate surface and that they are fixed to the side walls of the grate element.

3. A grate element according to claim 1, wherein the grate bars extend in the direction of movement of the material, in use, on the grate surface and that they are fixed to the end walls of the grate element.

4. A grate element according to any one of claims 1 to 3, wherein the grate bars having a rectangular cross section are cast in one piece with the walls of the grate element.

5. A grate element according to claim 4, wherein the grate bars with a T-shaped profile are separately manufactured and fixed to the walls of the grate element by welding.

6. A grate element according to claim 4, wherein the grate bars with a rectangular cross section constitute more than 50%, preferably between 65 and 85%, of the grate surface; whereas the T-bars constitute between 10 and 40%, and the gas channels constitute between 2 and 7% of the grate surface.

7. A grate element according to claim 4, wherein both the upwardly projecting and the downwardly depending beads are sized so that the gas inlet of each gas channel is situated at a higher level than an intermediate section of the gas channel.

8. A grate element according to claim 4, wherein the bars have surfaces which are facing the beads on the other bars, said surfaces having recesses towards, which the beads protrude.

9. A grate element according to claim 4, wherein the outlets of the channels terminate at an angle relative to the surface other than perpendicular.

10. A grate element according to any one of claims 1 to 3, wherein the rectangular grate bars are separately manufactured and fixed by means of fastening means.

11. A grate element according to claim 10, wherein the grate bars with a T-shaped profile are separately manufactured and fixed to the walls of the grate element by welding.

12. A grate element according to claim 10, wherein the grate bars with a rectangular cross section constitute more than 50%, preferably between 65 and 85%, of the active grate surface; whereas the T-bars constitute between 10 and 40%, and the gas channels constitute between 2 and 7% of the grate surface.

13. A grate element according to claim 10, wherein both the upwardly projecting and the downwardly depending beads are sized so that the gas inlet of each gas channel is situated at a higher level than an intermediate section of the gas channel.

14. A grate element according to claim 10, wherein the bars have surfaces which are facing the beads on the other bars, said surfaces having recesses towards, which the beads protrude.

15. A grate element according to claim 10, wherein the outlets of the channels terminate at an angle relative to the surface other than perpendicular.

16. A grate element according to any one of claims 1 to 3, wherein the grate bars with a T-shaped profile are separately manufactured and fixed to the walls of the grate element by welding.

17. A grate element according to claim 16, wherein the grate bars with a rectangular cross section constitute more than 50%, preferably between 65 and 85%, of the grate surface; whereas the T-bars constitute between 10 and 40%, and the gas channels constitute between 2 and 7% of the grate surface.

18. A grate element according to claim 16, wherein both the upwardly projecting and the downwardly depending beads are sized so that the gas inlet of each gas channel is situated at a higher level than an intermediate section of the gas channel.

19. A grate element according to claim 16, wherein the bars have surfaces which are facing the beads on the other bars, said surfaces having recesses towards, which the beads protrude.

20. A grate element according to claim 16, wherein the outlets of the channels terminate at an angle relative to the surface other than perpendicular.

21. A grate element according to any one of claims 1 to 3, wherein the grate bars with a rectangular cross section constitute more than 50%, preferably between 65 and 85%, of the grate surface; whereas the T-bars constitute between 10 and 40%, and the gas channels constitute between 2 and 7% of the grate surface.

22. A grate element according to claim 21, wherein both the upwardly projecting and the downwardly depending beads are sized so that the gas inlet of each gas channel is situated at a higher level than an intermediate section of the gas channel.

23. A grate element according to claim 21, wherein the bars have surfaces which are facing the beads on the other bars, said surfaces having recesses towards, which the beads protrude.

24. A grate element according to claim 21, wherein the outlets of the channels terminate at an angle relative to the surface other than perpendicular.

25. A grate element according to any one of claims 1–3, wherein both the upwardly projecting and the downwardly depending beads are sized so that the gas inlet of each gas channel is situated at a higher level than an intermediate section of the gas channel.

26. A grate element according to claim 25, wherein the grate bars having substantially rectangular cross section have recesses towards which respective longitudinal beads of the T-bars protrude, and the T-bars have recesses towards which respective longitudinal beads of the grate bars having substantially rectangular cross section protrude.

27. A grate element according to claim 26, wherein the outlets of the channels terminate at an angle relative to the surface other than perpendicular.

28. A grate element according to claim 25, wherein the bars have surfaces which are facing the beads on the other bars, said surfaces having recesses towards, which the beads protrude.

29. A grate element according to claim 25, wherein the outlets of the channels terminate at an angle relative to the surface other than perpendicular.

30. A grate element according to any one of claims 1–3, wherein the gas outlets terminate at an angle relative to the surface other than perpendicular.

* * * * *